United States Patent [19]

Russell et al.

[11] Patent Number: 5,013,968

[45] Date of Patent: May 7, 1991

[54] REPROGRAPHIC METAL HALIDE LAMPS HAVING LONG LIFE AND MAINTENANCE

[75] Inventors: Timothy D. Russell, Huntsburg; Carl H. Hess, Mentor-on-the-Lake; Paul G. Hlahol, South Euclid; Charles N. Stewart, Chagrin Falls, all of Ohio

[73] Assignee: General Electric Company, Schenectady, N.Y.

[21] Appl. No.: 322,146

[22] Filed: Mar. 10, 1989

[51] Int. Cl.[5] ..... H01J 61/18; H01J 61/22

[52] U.S. Cl. ..... 313/641; 313/571; 313/639

[58] Field of Search ..... 313/638, 639, 640, 641, 313/642, 570, 571

[56] References Cited

U.S. PATENT DOCUMENTS

| | | | |
|---|---|---|---|
| 3,234,421 | 2/1966 | Reiling | 313/571 X |
| 3,259,777 | 7/1966 | Fridrich | 313/570 |
| 3,445,719 | 5/1969 | Thouret et al. | 313/571 |
| 3,840,767 | 10/1974 | Lake | 313/639 |
| 3,876,895 | 4/1975 | Lake | 313/642 X |
| 3,919,581 | 11/1975 | Datta . | |
| 3,982,154 | 9/1975 | Mize et al. . | |
| 4,528,478 | 7/1985 | Rothwell, Jr. et al. | 313/638 X |
| 4,677,343 | 6/1987 | Hick | 313/113 X |

*Primary Examiner*—Palmer C. DeMeo

*Attorney, Agent, or Firm*—Edward M. Corcoran; Stanley C. Corwin; Fred Jacob

[57] ABSTRACT

Metal halide vapor arc lamps for reprographic and projection processes emitting in the blue, green and red bands with excellent primary color separation and having long life and lumen maintenance contain mercury, zinc, indium, lithium, thallium, a halogen and a rare earth metal such as lanthanum, scandium or dysporsium in the arc tube.

26 Claims, 1 Drawing Sheet

Fig. 1
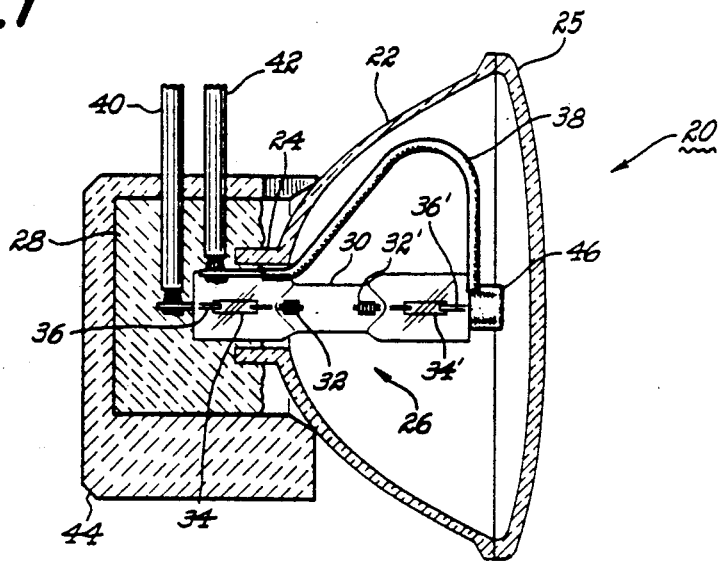
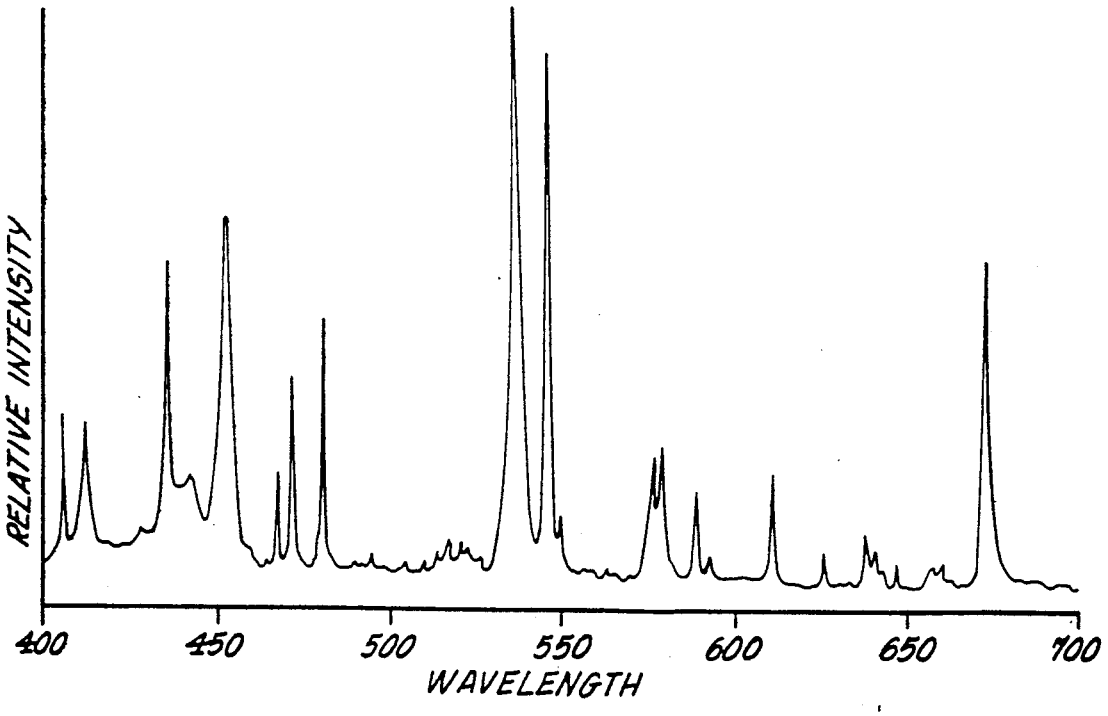
Fig. 2

REPROGRAPHIC METAL HALIDE LAMPS HAVING LONG LIFE AND MAINTENANCE

BACKGROUND OF THE INVENTION

1. Field of the Invention

This invention relates to selective spectral output metal halide arc discharge lamps having long life and lumen maintenance. More particularly, this invention relates to selective spectral output metal halide vapor arc lamps for reprographic and photographic processes emitting in the blue, green and red bands wherein the arc tube contains a fill comprising mercury, zinc, indium, lithium, thallium, at least one halogen and a rare earth metal.

2. Background of the Disclosure

Lamps intended for general lighting are designed to achieve the highest visible light radiation efficiency possible together with high color rendition at a specified color temperature. In most cases, this has resulted in solving problems to provide sufficient red radiation in order to achieve a good color rendition of the white light. In such lamps, the electrical characteristics are essentially those of a mercury discharge. However, there are other applications for electric lamps wherein emission scattered throughout the visible spectrum is undesirable. For instance, in reprographic applications for making colored copies, radiation concentrated in the three primary colors, blue, green and red is desired. The three primary colors can be achieved from light sources emitting continuously throughout the visible spectrum by means of filters. In this type of application the light beams are provided either from three separate light sources or by splitting the beam from a single white light source by means of optical filters. Such filters are used to eliminate from the light path everything except the desired primary color, and the three primary colors may then be recombined into a single beam. Such systems are prohibitively expensive as well as inefficient. Similarly, in some photochemical applications high energy emission in specific regions or bands is required in order to achieve a desired chemical reaction, and emission in other bands must be suppressed because it may inhibit the desired reaction and even produce undesirable side reactions.

The principles of color reproduction processes utilizing the three primary colors are well known. In such processes it is important that the light source employed emit radiation in the three primary color spectrums, blue, green and red at wavelengths which will be efficient in producing the desired reaction in the dyes and/or other chemical reagents used. In most color reprographic systems, the dyes, etc., which react with blue light are relatively insensitive to the light radiation in the blue color range. Also, blue light radiation is more readily absorbed by most media which results in low transmission. Consequently, lamps employed with such processes should emit a relatively high level of blue radiation in order to efficiently and effectively produce the desired chemical reaction and concomitant color change in the paper, emulsion, slide, phosphor, liquid crystal or other substrate.

Projection television systems also require light emission in the three primary colors, blue, green and red. The three primary colors containing the desired image or signal are separately projected on a screen wherein the colors combine to produce a desired light image. For color projection processes the primary objectives are good color reproduction and high screen brightness after passing through a medium in which the color information is contained (i.e., liquid crystals, slides, screens), with the lowest possible amount of power dissipation in the light radiation.

U.S. Pat. Nos. 3,840,767 and 3,876,895 describe selective spectral output metal halide vapor arc discharge lamps having light emissions concentrated in the blue, green and red energy bands wherein the relative emission characteristics or energy levels in the three bands are approximately 1:2:2, respectively and wherein little or no blue radiation is emitted at a wavelength of about 450 nm. Both of these lamps contain a fill comprising a mixture of halides of zinc, lithium and thallium, with the lamp of the '767 patent additionally containing a halide of gallium.

SUMMARY OF THE INVENTION

The present invention relates to metal halide lamps providing a source of radiation concentrated in the blue, green and red bands or regions of the visible light spectrum constituting the three primary colors. More particularly the present invention relates to a metal halide vapor arc discharge lamp containing a fill comprising mercury, zinc, indium, lithium, thallium, at least one halogen and a rare earth metal. After the lamp has been energized the arc chamber will contain a mixture of mercury, a halide of zinc, indium, lithium and thallium, and a rare earth metal which may or may not be in the halide form, depending on the particular rare earth metal. Preferably the halogen will comprise iodine and, concomitantly, the halides will comprise the iodides of these metals. Preferred rare earth metals include lanthanum, scandium and dysprosium, with lanthanum being particularly preferred. The presence of rare earth metal in the arc chamber has been found to provide at least an order of magnitude increase in lamp life (i.e., for a 100 watt lamp the life was increased from 20 hours to 1500 hours). Further, in one particular lamp of the invention, the presence of the rare earth metal also provided 100% lumen maintenance after 500 hours, compared to only 70% after 20 hours for the same lamp when the rare earth metal was not present.

BRIEF DESCRIPTION OF THE DRAWINGS

FIG. 1 illustrates a lamp assembly employing a compact metal halide arc discharge lamp according to an embodiment of the present invention.

FIG. 2 is a graph illustrating the spectral output of the visible light emitted by a lamp of the type illustrated in FIG. 1 in accordance with the present invention.

DETAILED DESCRIPTION

According to the present invention, there is provided a metal halide vapor arc discharge lamp wherein the arc chamber contains a fill of mercury, zinc, indium, lithium, thallium, at least one halogen and a rare earth metal. After the lamp is energized at least the indium, lithium, thallium and all or a portion of the zinc will be in the halide form. Thus, in these lamps the arc chamber will contain a fill comprising a mixture of mercury, and a halide of zinc, indium, lithium and thallium, along with at least one rare earth metal. It may also contain zinc metal, depending on the amount of zinc metal added prior to energization of the arc. These lamps emit visible light radiation in the blue, green and red bands, with at least a portion of the blue emission occurring at a wavelength of about 450 nm. By halogen is meant iodine, bromine, chlorine and mixture thereof and concomitantly, by halides is meant the iodides, bromides, chlorides and mixture thereof. Preferably only the iodides or bromides will be used. Iodine is particularly preferred. By rare earth metal is meant scandium Sc, yttrium Y, lanthanum La, cerium Ce, neodymium Nd, samarium Sm, europium Eu, gadolinium Gd, terbium Tb, dysprosium Dy, holmium Ho, erbium Er, thulium Tm, ytterbium Yb, lutetium Lu, thorium Th and mixture thereof. Lanthanum and dysprosium are preferred and, if employed in the arc chamber, it is preferred that at least a portion of these two metals, and more preferably all of the metal be in the form of the metal halide. Metals such as La and Dy emit a significant amount of radiation in the red portion of the spectrum if present in the arc chamber as the metal halide. On the other hand, the halides of metals such as Nd, Ho, Tm, Sc and Th emit blue radiation. If blue radiation from these metals is undesirable, then these metals will preferably be present in the arc chamber in the metallic form.

In general, with the lamps of this invention, the blue, green and red bands will be predominantly radiated at the wavelengths defined as follows:

| | |
|---|---|
| Blue | 400–480 nm |
| Green | 500–560 nm |
| Red | 600–700 nm. |

In this embodiment, visible radiation in the regions between the blue, green and red bands is undesirable and is preferably kept as low as possible. By undesirable radiation in the regions between the blue, green and red bands is meant radiation occurring between 570–600 nm and 480–510 nm.

It has been found that cleaner and crisper color images are achieved when radiation between the three primary color bands is reduced, particularly that which occurs between 480–510 nm and 570–600 nm. Thus, the more separate the three bands of emitted color are the cleaner the color reproduction becomes. Concomitantly, this color separation improves the lamp efficiency. Light radiation in regions of overlap between color bands, particularly 480–510 nm and 570–600 nm, increases image brightness at the expense of color information, thereby making an image appear over-exposed. The present invention substantially reduces and minimizes the energy emitted in these image confusing regions and permits the utilization of inexpensive color separating media without degrading image quality.

Accordingly, for some applications of color reproduction the lamps of the present invention have been found to produce cleaner and crisper images than has heretofore been possible. Further, the relatively high blue output has enabled lamps of the present invention to be useful in certain color projection processes wherein the final color image quality is closer to that occurring with natural sunlight than has heretofore been achieved. In one particular embodiment the ratio of the transmitted light energy in the blue, green and red color bands will be 1:1:1. Further, the intensity of these primary color bands can be more evenly distributed in color reproduction and transmission systems that, for one reason on other, result in significant absorption of blue light radiation. Still further, if desired the lamps of the present invention can be made to be useful for general lighting purposes wherein the color temperature is below about 6,000° K.

As set forth above, the lamps of the present invention comprise a metal halide arc discharge tube having an arc chamber which contains mercury, zinc, indium, lithium, thallium, at least one halogen and at least one rare earth metal. In one embodiment the arc chamber will be loaded with a fill comprising a mixture of mercury, zinc, at least one halide of each of zinc, indium, lithium and thallium, along with at least one rare earth metal or rare earth metal halide. The rare earth metal will preferably be at least one metal selected from the group consisting essentially of lanthanum, scandium and dysprosium. More preferably the rare earth metal will be selected from the group consisting essentially of lanthanum and dysprosium. It is particularly preferred that the rare earth metal include lanthanum. In a most preferred embodiment the rare earth metal will consist essentially of lanthanum. The lamps according to the present invention will also contain one or more inert gases and preferably one or more noble gases such as xenon, argon, krypton and mixture thereof as a starting gas. Xenon is particularly preferred from an energy/efficiency standpoint, while argon is preferred for longer life, easier starting and superior lumen maintenance. The inert gas will generally be employed in the arc tube at a pressure below about 760 torr. The amount of mercury employed in the arc tube will broadly range from about 10–35 mg/cc of arc tube volume (50–180 micromoles/cc), preferably from about 20–35 mg/cc (100–180 micromoles/cc) and still more preferably from about 20–30 mg/cc (100–150 micromoles/cc).

It is preferred that the amount of indium present in the arc tube not exceed about 25 mole % of the combined total moles of the indium, lithium and thallium present.

The amounts of the various metals present in the arc tube of the lamps of this invention are set forth in the table below:

| Metal | Micromoles per cc of Arc Chamber Volume |
|---|---|
| Hg | 50–180 |
| Zn | 0.1–52 |
| In | 0.4–6 |
| Tl | .06–15 |
| Li | 0.7–45 |
| Rare Earth Metal | 0.4–16 |
| La | .6–13.5 |
| Sc | .6–11 |
| Dy | .6–13.5 |

By way of an illustrative, but non-limiting example of the present invention wherein the metal halide species are introduced into the arc chamber in the form of the metal iodides, the amount of indium iodide InI introduced into the arc chamber will broadly range from between about 0.01 mg/cc to 1.5 mg/cc ($4\times10^{-8}$–$6\times10^{-6}$ moles/cc) of internal arc chamber volume; the amount of zinc iodide $ZnI_2$ introduced will range from about 0–3.0 mg/cc (0–$10\times10^{-6}$ moles/cc); the amount of lithium iodide LiI introduced will range from about 0.01 –6.0 mg/cc, ($7\times10^{-8}$–$4.5\times10^{-5}$ moles/cc) and the amount of thallium iodide TlI introduced will range from about 0.02–5.0 mg/cc ($6\times10^{-8}$–$1.5\times10^{-5}$ moles/cc) of internal arc chamber volume. The amount of mercury introduced will range from about 10–35 mg/cc ($5.0\times10^{-5}$–$1.8\times10-4$ moles/cc), the amount of rare earth metal introduced will range from about $6\times10^{-7}$ $-1.4\times10^{-5}$ moles/cc and the amount of zinc metal introduced will range from about 0.006 mg/cc-3.0 mg/cc ($1\times10^{-7}$-$4.2\times10^{-5}$ moles/cc).

The amount of rare earth metal present in the arc chamber is somewhat dependent on the particular rare earth metal or metals used and whether said metal or metals are present as metal or as metal halide. By way of an illustrative, but non-limiting example, if scandium is present, it is preferred to have it present as the metal and not as a metal halide (i.e., 0.03-0.5 mg/cc or $6\times10^{-7}$-$1.1$-$10^{-5}$ moles/cc). On the other hand, lanthanum is preferably present as lanthanum halide and not as lanthanum metal. Thus, if lanthanum iodide is present, it will be present in an amount generally ranging from about 0.3-7.0 mg/cc ($6\times10^{-7}13.5\times10^{-6}$ moles/cc). If dysprosium iodide is present instead of lanthanum iodide it will generally range from about 0.3-7.3 mg/cc ($6\times10^{-7}$-$13.5\times10^{-6}$ moles/cc).

Lamp manufacturing processes vary according to equipment on hand, needs, availability of materials, etc. However, in all manufacturing processes it is possible for small quantities of oxygen and/or moisture to be present in the arc tube when it is being filled with the metal halides. This causes some of the metal halide to react with the oxygen and/or moisture during initial lamp operation, thereby releasing the halide in the arc tube. The presence of such "excess" halide in the arc tube is detrimental to the operation of the lamp. Accordingly, it has been found that the addition of small quantities of zinc, as zinc metal alone, or amalgamated with mercury, acts as a scavenger to take up such "excess" halide without any detrimental effect on the spectral distribution of the lamp. This has been found to improve lamp efficiency in terms of watts of useful light output per watt of electrical input by 10-20% and to prolong useful lamp life. The amount of zinc metal added, on a mole basis, will depend on the amount of and which rare earth species is added, and whether it is added as a metal or as a halide. For example, if scandium metal is added in a range of 5-100 micrograms for a 0.20 cc actual volume or $1.1\times10^{-7}$ to $2.2\times10^{-6}$ moles, then an amount of zinc metal must be added ranging from $1.6\times10-7$ moles to $6.6\times10^{-6}$ moles or 11 to 430 micrograms. If $LaI_3$ is added, in a range from 0.3 to 7.0 mg/cc ($6\times10^{-7}$-$13.5\times10^{-6}$ moles/cc) of arc chamber volume, then zinc metal, generally amalgamated with mercury is added, with the amount of zinc metal present in the arc chamber in an amount of from about $2\times10^{-7}$ moles to $9\times10^{-7}$ moles or 0.065 to 0.25 mg/cc of arc chamber volume. Moreover, all or a portion of the mercury may be introduced into the arc tube in the form of a mercuric halide and, concomitantly, all or a portion of the indium, zinc, thallium and rare earth metal may be introduced into the arc tube in the form of the metal. When the arc is energized, these metals, being more reactive than mercury, will react with the halide of the mercury halide to form mercury and the corresponding halides of the metals in the arc tube.

FIG. 1 illustrates a compact type of lamp and reflector assembly employing a compact metal halide vapor arc discharge lamp according to the present invention. Referring to FIG. 1, lamp and reflector assembly 20 consists of reflector 22 having a nose portion 24 protruding rearwardly through which a compact metal halide arc tube 26 projects with the arc portion of arc tube 26 located at the optical center of reflector 22. Glass cover or lens 25 is cemented or glued to reflector 22. In this embodiment reflector 22 is an all glass reflector. However, it is not intended to limit the present invention to use with an all glass reflector. Lamp 26 comprises arc discharge tube 30 made of quartz containing therein tungsten electrodes 32 and 32'. The distance between electrodes 32 and 32' is one-half cm. Electrodes 32 and 32' are connected at the other ends thereof by suitable means, such as welding, to molybdenum foil seal strips 34 and 34' which are pinch sealed into the respective ends of arc tube 30 and which, turn, are connected to inleads 36 and 36'. Lamp or arc tube 30 is cemented into reflector 22 by means of a suitable refractory cement 28 such as a sodium or potassium silicate cement or an aluminum phosphate type of cement which also serves to cement ceramic lamp base 44 in place. Inlead 36' at one end of lamp 26 is welded to connecting lead 38 which extends down through the nose portion 24 of the glass reflector and which is welded at its other end to lead 42. Ceramic cap 46 is cemented at the end of lamp 30 to protect the junction of inlead 36 and conductive lead 38. At the other end of lamp 26 inlead 36 is welded to conductor 40. Each of the two electrodes 32 and 32' comprises tungsten wire impregnated with 1-2 wt. % of thorium oxide. The interior volume of the arc chamber or tube 30 is 0.20 cc and contains argon gas at a pressure of about 275 torr. During lamp manufacture a fill is introduced into the interior of arc tube 30 which consists essentially of 23 milligrams of mercury per cubic centimeter of arc tube volume, about 0.15 mg/cc ($5\times10^{-6}$ moles/cc) of zinc metal; 0.2 milligrams/cc ($8\times10^{-7}$ moles/cc) of indium iodide; 0.9 mg/cc ($3\times10$hu $-6$ moles/cc) of thallium iodide; 1.1 mg/cc ($3\times10^{7}$ moles/cc) of zinc iodide; 0.2 mg/cc ($7.4\times10^{-7}$ moles/cc) of lithium iodide, and 1.1 mg/cc ($2\times10^{-6}$ moles/cc) of lanthanum triiodide.

FIG. 2 is a curve of the spectral emission of the lamp depicted in FIG. 1 which contain the fill and dimensions set forth above. This lamp was operated at 100 watts at a nominal input voltage of about 70 volts and had a total light output of about 7125 lumens. This type of lamp is useful for visual applications such as in a projection color TV and radiates visible light emission at 510-525 nm and 630-650 nm, which is different from prior art lamps.

What is claimed is:

1. A metal halide arc discharge lamp emitting primarily in the blue, green and red portions of the visible light spectrum and not continuously across the visible spectrum and with at least a portion of the blue emission at a wavelength of about 450 nm, said lamp comprising a light transmissive, vitreous, hermetically sealed arc chamber enclosing a pair of electrodes therein which protrude into said arc chamber, said arm chamber further containing mercury, an inert gas, at least one halogen, zinc, indium, lithium, thallium, and at least one rare earth metal, wherein the amount of indium present is no greater than about 25 mole % of the total of said indium, lithium and thallium and wherein said at least one halogen is present in an amount sufficient to insure that at least said indium, lithium, thallium and at least a portion of said zinc are present as metal halides during operation of said lamp, but not in excess of that amount required for said indium, lithium, thallium, zinc and rear earth metal to be present as metal halide during operation of said lamp.

2. The lamp of claim 1 wherein said inert gas comprises one or more noble gasses.

3. The lamp of claim 2 wherein said at least one rare earth metal is selected from the group consisting of Sc, Y, La, Ce, Nd, Sm, Eu, Gd, Tb, Dy, Ho, Er, Tm, Yb, Lu, Th and mixture thereof.

4. The lamp of claim 3 wherein said at least one rare earth metal is present as metal during operation of said lamp.

5. The lamp of claim 3 wherein said one or more noble gas is selected from the group consisting of xenon, argon, krypton and mixture thereof.

6. The lamp of claim 5 wherein said at least one halogen is selected from the group consisting of iodine, bromine, chlorine and mixture thereof.

7. The lamp of claim 6 wherein the amount of said metal present in said arc chamber in micromoles per cubic centimeter of arc chamber volume ranges from about 50–180 for mercury, 0.1–52 for zinc, 0.4–6 for indium, 0.6–15 for thallium, 0.7–45 for lithium and 0.4–16 for rare earth metal.

8. The lamp of claim 7 wherein said at least one halogen is selected from the group consisting of iodine, bromine and mixture thereof.

9. The lamp of claim 8 wherein said at least one rare earth metal is selected from the group consisting of lanthanum, scandium, dysprosium and mixture thereof.

10. The lamp of claim 9 wherein said at least one rare earth metal is selected from the group consisting of lanthanum, dysprosium and mixture thereof which are present as halides during operation of said lamp.

11. The lamp of claim 10 wherein said at least one rare earth metal comprises lanthanum.

12. The lamp of claim 11 wherein said at least one halogen consists of iodine.

13. The lamp of claim 12 wherein said at least one rare earth metal consists of lanthanum.

14. The lamp of claim 1 wherein the ratio of intensity of said blue, green and red emission is about 1:1:1.

15. The lamp of claim 1 in combination with a reflector.

16. A metal halide arc discharge lamp emitting primarily in the blue, green and red portions of the visible light spectrum at a wavelength of about 400–480 nm, and 600–700 nm, respectively, and not continuously across the visible spectrum and with at least a portion of the blue emission at a wavelength of about 450 nm, said lamp comprising a light transmissive, vitreous arc tube having an arc chamber therein and enclosing a pair of electrodes which protrude into said arc chamber and are hermetically sealed in said arc tube, said arc chamber containing an inert gas comprising at least one noble gas, at least one halogen, mercury, zinc, indium, thallium, lithium, and at least one rare earth metal, said indium being present in an amount no greater than about 25 mole % of the combined total of said indium, lithium and thallium, with said at least one halogen being present in an amount sufficient to insure that at least said indium, lithium, thallium and at least a portion of said zinc are present as metal halide during operation of said lamp, but not in excess of that amount required for said indium, lithium, thallium, zinc and rare earth metal to be present as metal halide during operation of said lamp.

17. The lamp of claim 16 in combination with a reflector.

18. The lamp of claim 16 wherein said at least one halogen is selected from the group consisting of iodine, bromine, chlorine and mixture thereof.

19. The lamp of claim 18 wherein said at least one rare earth metal is selected from the group consisting of scandium, yttrium, lanthanum, cerium, neodymium, samarium, europium, gadolinium, terbium, dysprosium, holmium, erbium, thulium, ytterbium, lutertium, thorium and mixture thereof.

20. The lamp of claim 19 wherein said at least one rare earth metal is present as metal during operation of said lamp.

21. The lamp of claim 19 wherein said at least one noble gas is selected from the group consisting of xenon, argon, krypton and mixture thereof.

22. The lamp of claim 21 wherein said at least one halogen is selected from the group consisting of iodine and bromine.

23. The lamp of claim 22 wherein the amount of said metal present in said arc chamber in micromoles per cubic centimeter of arc chamber volume ranges from about 50–180 for mercury, 0.1–52 for zinc, 0.4–6 for indium, 0.6–15 for thallium, 0.7–45 for lithium and 0.4–16 for rare earth metal.

24. The lamp of claim 23 wherein said at least one rare earth metal is selected from the group consisting of lanthanum, scandium dysprosium and mixture thereof, wherein said lanthanum and dysprosium, if present, are present as metal halide during operation of said lamp and said scandium, if present, is present as metal during operation of said lamp.

25. The lamp of claim 24 wherein said at least one rare earth metal is selected from the group consisting of lanthanum, dysprosium and mixture thereof.

26. The lamp of claim 24 in combination with a reflector and wherein said lamp comprises a compact lamp.

* * * * *